US006189491B1

(12) United States Patent
Wittchow et al.

(10) Patent No.: US 6,189,491 B1
(45) Date of Patent: Feb. 20, 2001

(54) STEAM GENERATOR

(75) Inventors: Eberhard Wittchow, Erlangen; Joachim Franke, Altdorf; Rudolf Kral, Erlangen, all of (DE)

(73) Assignee: Siemens Aktiengesellschaft, Munich (DE)

( * ) Notice: Under 35 U.S.C. 154(b), the term of this patent shall be extended for 0 days.

(21) Appl. No.: 09/333,146

(22) Filed: Jun. 14, 1999

Related U.S. Application Data

(63) Continuation of application No. PCT/DE97/02800, filed on Dec. 1, 1997.

(30) Foreign Application Priority Data

Dec. 12, 1996 (DE) ..... 196 51 678

(51) Int. Cl.[7] ..... F22D 1/00; F28F 13/06

(52) U.S. Cl. ..... 122/1 C; 122/7 R; 165/145; 165/146

(58) Field of Search ..... 165/145, 146; 122/1 C, 7 R

(56) References Cited

U.S. PATENT DOCUMENTS

| | | | | |
|---|---|---|---|---|
| 2,126,248 | | 8/1938 | Eule . | |
| 4,026,352 | * | 5/1977 | Andoniev et al. | 122/7 R X |
| 4,627,386 | * | 12/1986 | Duffy et al. | 122/7 R |
| 4,738,224 | * | 4/1988 | Bruckner et al. | 122/7 R |
| 5,131,459 | | 7/1992 | Thompson et al. . | |
| 5,628,179 | * | 5/1997 | Tomlinson | 122/7 R X |
| 5,660,037 | * | 8/1997 | Termuehlen | 122/7 R X |
| 5,775,266 | * | 7/1998 | Ziegler | 122/7 R |

FOREIGN PATENT DOCUMENTS

| | | | | |
|---|---|---|---|---|
| 2621340 | | 11/1977 | (DE) . | |
| 4216278 | | 11/1993 | (DE) . | |
| 4227457 | | 2/1994 | (DE) . | |
| 0326388 | | 8/1989 | (EP) . | |
| 0352488 | | 1/1990 | (EP) . | |
| 1558043 | | 2/1969 | (FR) . | |
| 1-189401 | * | 7/1989 | (JP) | 122/7 R |
| 6-221504 | * | 8/1994 | (JP) | 122/7 R |
| 13356 | | 7/1993 | (WO) . | |

OTHER PUBLICATIONS

"Verdampfungskonzepte für Benson®–Dampferzeuger", J. Franke et al., VGB Kraftwerkstechnik 73, 1993, vol. 4, pp. 352–361.

* cited by examiner

*Primary Examiner*—Leonard Leo
(74) *Attorney, Agent, or Firm*—Herbert L. Lerner; Laurence A. Greenberg; Werner H. Stemer

(57) ABSTRACT

A steam generator which is both suitable for a horizontal mode of construction and offers the advantages of a continuous steam generator. According to the invention, a steam generator has at least one continuous heating surface disposed in a duct where hot gas circulates in a substantially horizontal direction. The heating surface consists of a plurality of parallel and almost vertical pipes which are used to circulate a fluid, and is configured in such a way that the fluid circulating in a tube heated to a greater temperature than the following tube of the same continuous heating surface has a higher flow rate than the fluid circulating in the following tube.

22 Claims, 4 Drawing Sheets

STEAM GENERATOR

CROSS-REFERENCE TO RELATED APPLICATION

This application is a continuation of copending International Application No. PCT/DE97/02800, filed Dec. 1, 1997, which designated the United States.

BACKGROUND OF THE INVENTION

Field of the Invention

The invention relates to a steam generator.

In a gas and steam-turbine plant, the heat contained in the expanded working medium or heating gas from the gas turbine is utilized for the generation of steam for the steam turbine. The heat transfer is effected in a waste-heat steam generator, which is disposed down-stream of the gas turbine and in which a number of heating areas for the water preheating, the steam generation and the steam superheating are normally disposed. The heating areas are connected in the water/steam circuit of the steam turbine. The water/steam circuit normally contains several, e.g. three, pressure stages, in which case each pressure stage may have an evaporator heating area.

For the steam generator disposed as a waste-heat steam generator downstream of the gas turbine on the heating-gas side, a number of alternative configuration concepts are suitable, namely the configuration as a once-through steam generator or as a circulation steam generator. In the case of a once-through steam generator, the heating of steam-generator tubes provided as evaporator tubes leads to evaporation of the flow medium in the steam-generator tubes in a single pass. In contrast, in the case of a natural or forced-circulation steam generator, the circulating water is only partly evaporated when passing through the evaporator tubes. The water that is not evaporated in the process is fed again to the same evaporator tubes for further evaporation after separation of the generated steam.

A once-through steam generator, in contrast to a natural or forced-circulation steam generator, is not subject to any pressure limitation. Therefore, live-steam pressures well above the critical pressure of water ($P_{cri}$=221 bar), where there is only a slight difference in density between a medium similar to a liquid and a medium similar to steam, are possible. A high live-steam pressure promotes a high thermal efficiency and thus low $CO_2$ emissions of a fossil-fired power station. In addition, a once-through steam generator has a simple type of construction compared with a circulation steam generator and can therefore be manufactured at an especially low cost. The use of a steam generator configured according to the once-through principle as a waste-heat steam generator of a gas and steam-turbine plant is therefore especially favorable for achieving a high overall efficiency of the gas and steam-turbine plant in a simple type of construction.

A once-through steam generator may in principle, be made in one of two alternative constructional styles, namely in upright type of construction or in horizontal type of construction. Here, a once-through steam generator in a horizontal type of construction is configured for a through-flow of the heating medium or heating gas, for example the exhaust gas from the gas turbine, in an approximately horizontal direction, whereas a once-through steam generator in an upright type of construction is configured for a throughflow of the heating medium in an approximately vertical direction.

A once-through steam generator in the horizontal type of construction, in contrast to a once-through steam generator in the upright type of construction, can be manufactured with especially simple means and at an especially low production and assembly cost. In the case of a once-through steam generator with horizontal type of construction, however, the steam-generator tubes of a heating area, depending on their positioning, are subjected to heating that differs greatly.

In particular in the case of steam-generator tubes leading on the outlet side into a common discharge collector, however, different heating of individual steam-generator tubes may lead to the funneling of steam flows having steam parameters differing greatly from one another and thus to undesirable efficiency losses, in particular to comparatively reduced effectiveness of the relevant heating area and consequently reduced steam generation.

In addition, different heating of adjacent steam-generator tubes, in particular in the region where they lead into a discharge collector, may result in damage to the steam-generator tubes or the collector.

Summary of the Invention

It is accordingly an object of the invention to provide a steam generator which overcomes the above-mentioned disadvantages of the prior art devices of this general type, which is suitable for a horizontally configured construction and in addition has the advantages of a once-through steam generator. Furthermore, the steam generator is to make possible an especially high efficiency of a fossil-fired power station.

With the foregoing and other objects in view there is provided, in accordance with the invention, a steam generator, including:

a heating-gas duct; and at least one once-through heating area is disposed in the heating-gas duct through which a flow is conducted in an approximately horizontal heating-gas direction, the at least one once-through heating area formed from a number of approximately vertically disposed steam-generator tubes connected in parallel for a through flow of a flow medium, the steam-generator tubes are configured such that a steam-generator tube of the steam-generator tubes heated to a greater extent compared with a further steam-generator tube of the steam-generator tubes has a higher flow rate of the flow medium compared with the further steam-generator tube.

Here, the expression once-through heating area refers to a heating area that is configured according to the once-through principle. The flow medium fed to the once-through heating area is thus completely evaporated in a single pass through the once-through heating area or through a heating-area system containing a plurality of once-through heating areas connected one behind the other. At the same time, a once-through heating area of such a heating-area system can also be provided for the preheating or for the superheating of the flow medium. In this configuration, the once-through heating area or each once-through heating area may contain a number of tube layers, in particular like a tube nest, which are disposed one behind the other in the heating-gas direction and each of which is formed from a number of steam-generator tubes disposed next to one another in the heating-gas direction.

The invention is based on the idea that, in the case of a steam generator suitable for an embodiment in a horizontal type of construction, the effect of locally different heating on the steam parameters should be kept especially small for a high efficiency. For especially small differences between the steam parameters in two adjacent steam-generator tubes, the medium flowing through the steam-generator tubes, after its discharge from the steam-generator tubes, should have approximately the same temperature and/or the same steam content for each steam-generator tube allocated to a common once-through heating area. Adaptation of the temperatures of the flow medium discharging from the respective steam-generator tubes can be achieved even during, different heating of the respective steam-generator tubes by each steam-generator tube being configured for a medium throughflow adapted to its average heating, which depends on its position in the heating-gas duct.

For an especially favorable adaptation of the flow rate of the flow medium to the heating of the respective steam-generator tube in the case of a steam generator configured for a full-load pressure at a superheater discharge of more than 80 bar, the steam-generator tubes of at least one once-through heating area are advantageously configured or dimensioned on average for a ratio of friction pressure loss to a geodetic pressure drop at a full load of less than 0.4, preferably less than 0.2. In the case of a steam generator having a pressure stage that is configured for a full-load pressure at the superheater discharge of 80 bar or less, the steam-generator tubes of the at least one once-through heating area of this pressure stage are advantageously configured on average for a ratio of the friction pressure loss to the geodetic pressure drop at full load of less than 0.6, preferably less than 0.4. This is based on the knowledge that different heating of two steam-generator tubes leads to especially small temperature differences and/or differences in the steam content of the flow medium at the outlets of the respective steam-generator tubes when heating of a steam-generator tube to a greater extent leads on account of its configuration to an increase in the flow rate of the flow medium in this steam-generator tube.

This can be achieved in an especially simple manner by a friction pressure loss that is especially low compared with the geodetic pressure drop. Here, the geodetic pressure drop indicates the pressure drop on account of the weight of the water column and steam column relative to the area of the cross-section of flow in the steam-generator tube. The friction pressure loss, on the other hand, describes the pressure drop in the steam-generator tube as a result of the flow resistance for the flow medium. The total pressure drop in a steam-generator tube is essentially composed of the geodetic pressure drop and the friction pressure loss.

During especially intense heating of an individual steam-generator tube, the steam generation in the steam-generator tube becomes especially high. The weight of the medium that has not evaporated in the steam-generator tube therefore decreases, so that the geodetic pressure drop in the steam-generator tube likewise decreases. However, all steam-generator tubes connected in parallel inside the once-through heating area have the same total pressure drop on account of their common inlet-side connection to an entry collector and their common outlet-side connection to a discharge collector. If there is a geodetic pressure drop in one of the steam-generator tubes that is especially low compared with the steam-generator tubes connected in parallel with it on account of its especially intense heating, an especially large quantity of flow medium then flows for a pressure balance through the tube heated to a greater degree if the geodetic pressure drop is on average the dominant portion of the total pressure drop on account of the configuration of the once-through heating area.

In other words a steam-generator tube heated more intensely compared with the steam-generator tubes connected in parallel with it has an increased flow rate of flow medium. Whereas a steam-generator tube heated to an especially low degree compared with the steam-generator tubes connected in parallel with it has an especially low flow rate of flow medium. By a suitable specification of the ratio of friction pressure loss to geodetic pressure drop due to the configuration of the steam-generator tubes, in particular with regard to the selected mass-flow density in the steam-generator tubes, this effect can be utilized for automatic adaptation of the flow rate of each steam-generator tube to its heating.

In the construction of the steam-generator tubes with regard to the ratio of the friction pressure loss to the geodetic pressure drop, the relevant variables can be determined according to the relationships specified in the publications Q. Zheng, W. Köhler, W. Kastner and K.Riedle "Druckverlust in glatten und innenberippten Verdampferrohren", W ärme- und Stoffübertragung 26,pp. 323–330, Springer-Verlag 1991, and Z. Rouhani "Modified Correlation for Void-Fraction and Two-Phase Pressure Drop", AE-RTV-841, 1969. Here, for a steam generator configured for a full-load pressure at the superheater discharge of 180 bar or less, its characteristic values are to be used for the full-load operating state. On the other hand, for a steam generator configured for a full-load pressure of more than 180 bar, its characteristic values are to be used for a part-load operating state at an operating pressure at the superheater discharge of about 180 bar.

As extensive tests have shown, the automatic increase in the flow rate of flow medium when the steam-generator tube is heated to a greater degree, which increase is the intention of the configuration criterion for the steam-generator tubes, also occurs within a pressure range above the critical pressure of the flow medium. In addition, in the case of a once-through heating area to which a water/steam mixture flows in the configuration case, the intended automatic increase in the flow rate when a steam-generator tube is heated to a greater degree also occurs when the friction pressure loss in the steam-generator tube is on average about five times higher than in the case of a steam-generator tube of a once-through heating area to which merely water flows in the configuration case.

Each steam-generator tube of the once-through heating area is expediently configured for a higher flow rate of the flow medium than each steam-generator tube disposed downstream of it in the heating-gas direction and belonging to the same once-through heating area.

In an alternative or additional advantageous development, a steam-generator tube of the once-through heating area or of each once-through heating area has a larger inside diameter than a steam-generator tube disposed downstream of it in the heating-gas direction and belonging to the same once-through heating area. This ensures in an especially simple manner that the steam-generator tubes in the region of comparatively high heating-gas temperature have a comparatively high flow rate of flow medium.

In a further alternative or additional advantageous development, a choke device is connected upstream of a number of steam-generator tubes of the once-through heating area or of each once-through heating area in the direction of flow of the flow medium. In this configuration, in particular in the configuration case, steam-generator tubes heated to a lower degree compared with steam-generator tubes of the same once-through heating area can be provided with the choke device. The flow rate through the steam-generator tubes of a once-through heating area can therefore be controlled, so that an additional adaptation of the flow rate to the heating is made possible. In this case, a choke device may also be connected in each case upstream of a group of steam-generator tubes.

In a further alternative or additional advantageous development, in each case a plurality of entry collectors and/or a plurality of discharge collectors are allocated to the once-through heating area or to each once-through heating area. Each entry collector being commonly connected upstream of a number of steam-generator tubes of the respective once-through heating area in the direction of flow of the flow medium or each discharge collector being commonly connected downstream of a number of steam-generator tubes of the respective once-through heating area. Thus an especially favorable spatial configuration of the steam-generator tubes in their region adjoining the entry collectors is possible.

For especially high heat absorption, the steam-generator tubes expediently have ribbing on their outside. In addition, each steam-generator tube may expediently be provided with thread-like ribbing on its inner wall in order to increase the heat transfer from the steam-generator tube to the flow medium flowing in it.

The steam generator is expediently used as a waste-heat steam generator of a gas and steam-turbine plant. In this case, the steam generator is advantageously disposed downstream of a gas turbine on the heating-gas side. In this circuit, supplementary firing for increasing the heating-gas temperature may expediently be disposed behind the gas turbine.

The advantages achieved by the invention consist in particular in the fact that a steam generator which is especially favorable for achieving an especially high overall efficiency of a gas and steam-turbine plant can also be made in a horizontal type of construction and thus at an especially low production and assembly cost. In this case, material damage to the steam generator on account of the heating of the steam-generator tubes, which is spatially inhomogeneous to an especially high degree, is reliably avoided on account of the fluidic configuration of the steam generator.

Other features which are considered as characteristic for the invention are set forth in the appended claims.

Although the invention is illustrated and described herein as embodied in a steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
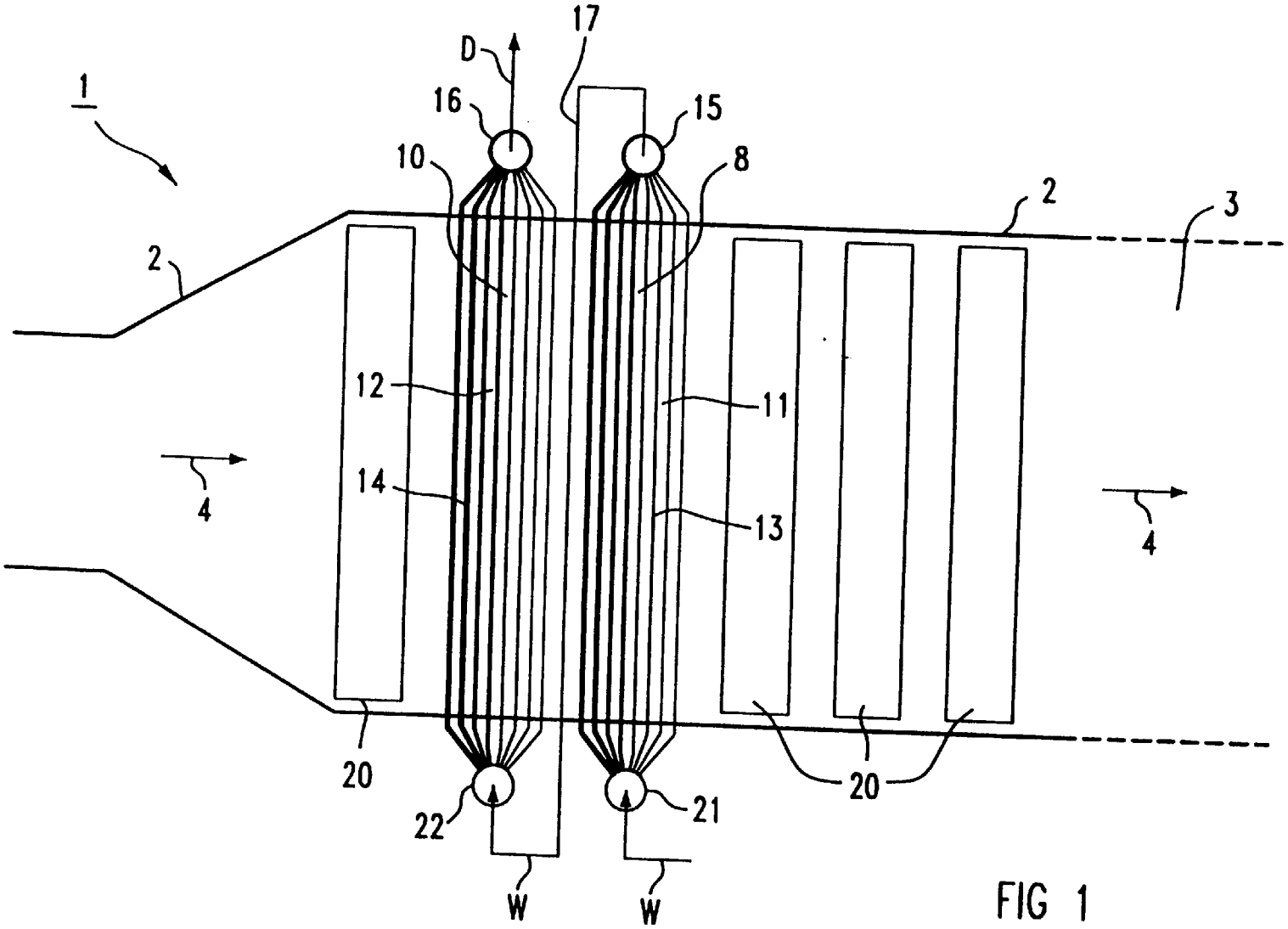
FIGS. 1, 2 and 3 are diagrammatic, simplified, longitudinal sectional views of a steam generator with a horizontal type of construction according to the invention.

In all the figures of the drawing, sub-features and integral parts that correspond to one another bear the same reference symbol in each case. Referring now to the figures of the drawing in detail and first, particularly, to FIGS. 1–3 thereof, there is shown a steam generator 1, for example a waste-heat steam generator, disposed downstream of a gas turbine (not shown in any more detail) on an exhaust-gas side. The steam generator 1 has an enclosing wall 2 which forms a heating-gas duct 3 through which flow can occur in an approximately horizontal heating-gas direction indicated by the arrows 4 and which is intended for the exhaust gas from the gas turbine. A number of heating areas which are configured according to the once-through principle and are also designated as, once-through heating areas 8, 10 are disposed in the heating-gas duct 3. In the exemplary embodiment according to FIGS. 1, 2 and 3, in each case two of the once-through heating areas 8, 10 are shown, but merely one once-through heating area or a larger number of once-through heating areas may also be provided.

Figure 2:
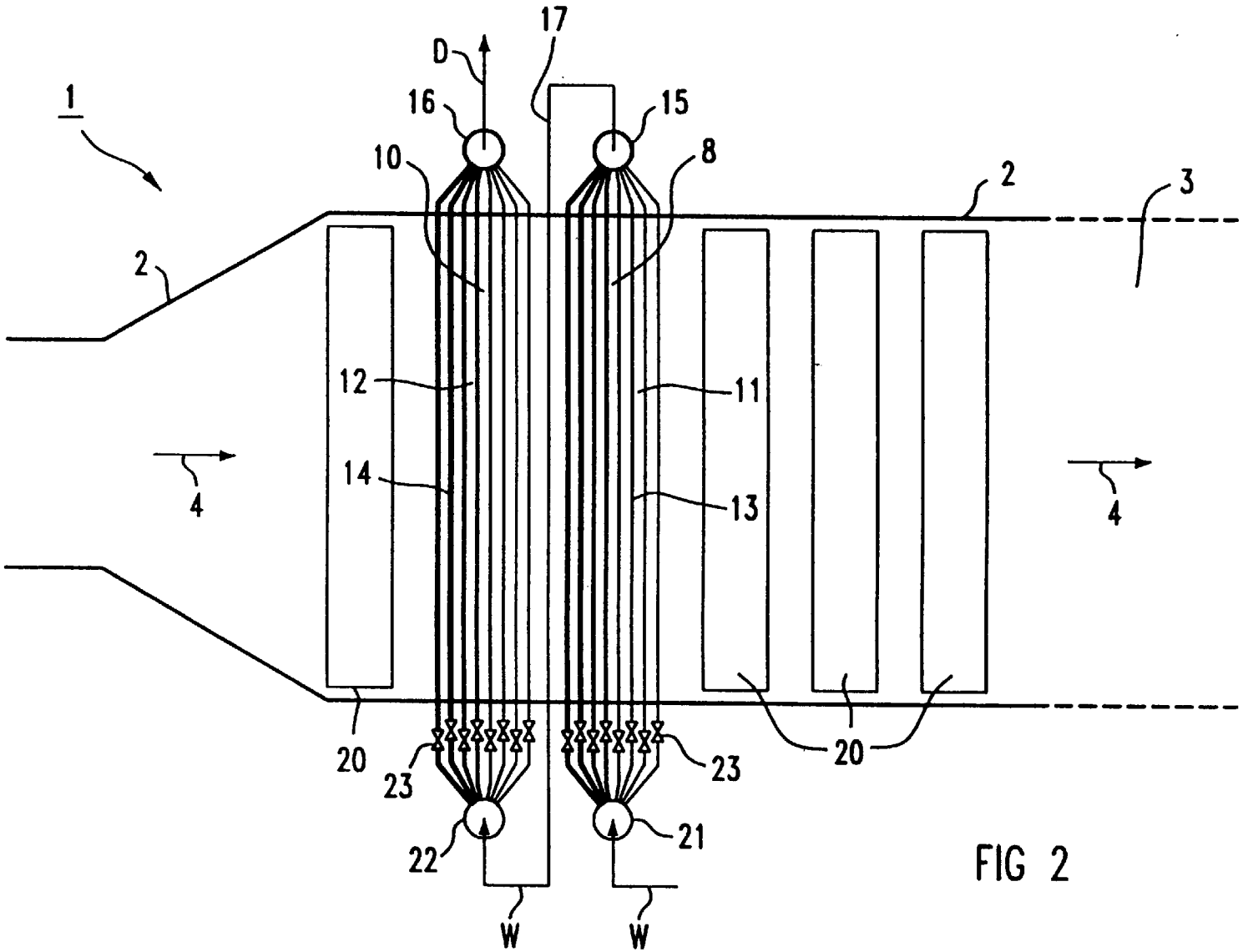
Figure 3:
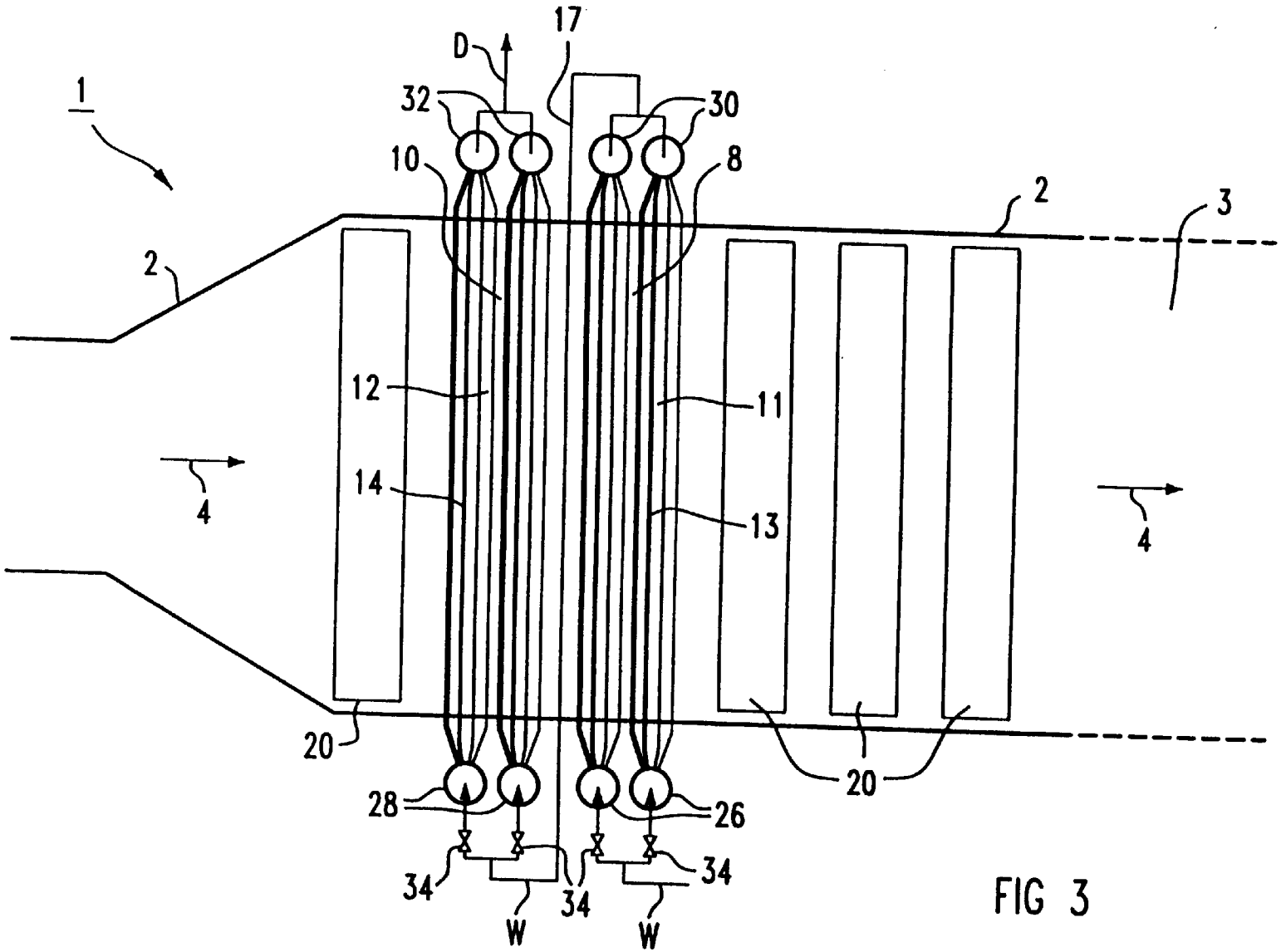

The once-through heating areas 8, 10 according to FIGS. 1, 2 and 3 contain a number of tube layers 11 and 12 respectively, in each case like a tube nest, which are disposed one behind the other in the heating-gas direction. Each tube layer 11, 12 in turn has a number of steam-generator tubes 13 and 14 respectively, which are disposed next to one another in the heating-gas direction and of which in each case only one can be seen for each tube layer 11, 12. In this case, the approximately vertically disposed steam-generator tubes 13, connected in parallel for the throughflow of a flow medium W, of the first once-through heating area 8 are connected on the outlet side to a discharge collector 15 common to them. On the other hand, the likewise approximately vertically disposed steam-generator tubes 14, connected in parallel for the throughflow of the flow medium W, of the second once-through heating area 10 are connected on the outlet side to a discharge collector 16 common to them. The steam-generator tubes 14 of the second once-through heating area 10 are fluidically disposed downstream of the steam-generator tubes 13 of the first once-through heating area 8 via a downpipe system 17.

The flow medium W can be admitted to the evaporator system formed from the once-through heating areas 8, 10, which flow medium W evaporates on passing once through the evaporator system and is drawn off as steam D after discharge from the second once-through heating area 10. The evaporator system formed from the once-through heating areas 8, 10 is connected in the water/steam circuit (not shown in any more detail) of the steam turbine. In addition to the evaporator system containing the once-through heating areas 8, 10, a number of further heating areas 20 indicated schematically in FIGS. 1, 2 and 3 are connected in the water/steam circuit of the steam turbine. The heating areas 20 may, for example, be superheaters, intermediate-pressure evaporators, low-pressure evaporators and/or preheaters.

The once-through heating areas 8, 10 are configured in such a way that local differences in the heating of the steam-generator tubes 13 and 14 respectively only lead to small temperature differences or differences in the steam content in the flow medium W discharging from the respective steam-generator tubes 13 and 14. In this case, each steam-generator tube 13, 14, as a result of the configuration of the respective once-through heating area 8, 10, has a higher flow rate of the flow medium W than each steam-generator tube 13 or 14 disposed downstream of it in the heating-gas direction and belonging to the same once-through heating area 8 or 10 respectively.

Figure 4:
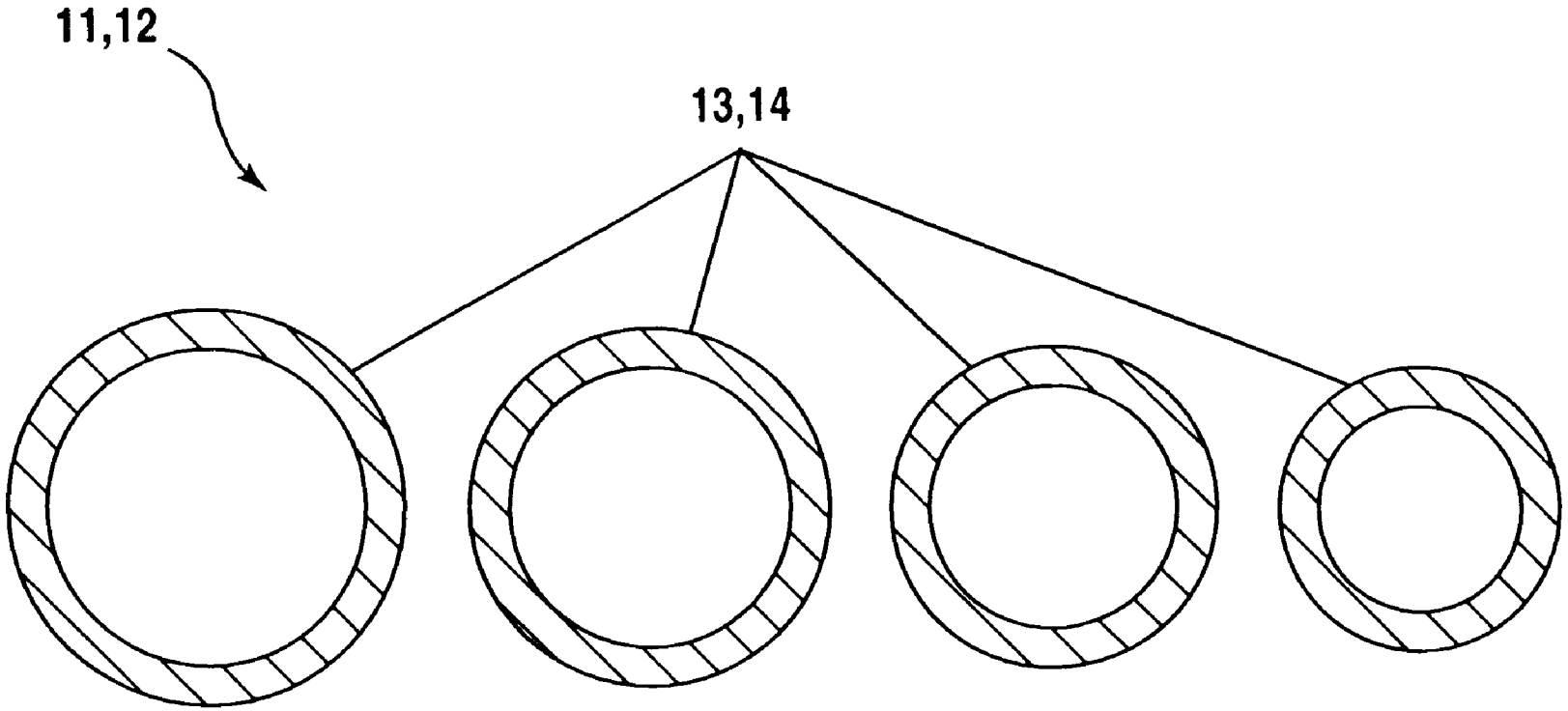
FIG. 4 is a diagrammatic, cross-sectional representation of pipes having an increasing inner diameter from right to left.

In the exemplary embodiment according to FIG. 1, the steam-generator tubes 13 of the first once-through heating area 8, which are connected on the inlet side to an entry collector 21, are configured in such a way that, during full-load operation of the steam generator 1, the ratio of a friction pressure loss to a geodetic pressure drop within the respective steam-generator tube 13 is on average less than 0.2. On the other hand, the steam-generator tubes 14 of the second once-through heating area 10, which are connected on the inlet side to an entry collector 22, are configured in such a way that, during full-load operation of the steam generator 1, the ratio of the friction pressure loss to the geodetic pressure drop within the respective steam-generator tube 14 is on average less than 0.4. In addition, each steam-generator tube 13, 14 of the once-through heating area 8 or 10 respectively may have a larger inside diameter than each steam-generator tube 13 or 14 disposed downstream of it in the heating-gas direction and belonging to the same once-through heating area 8 or 10. See, i.e., FIG. 4.

In the exemplary embodiment according to FIG. 2, a valve, such as a choke device 23, is in each case connected upstream of each steam-generator tube 13, 14 of the once-through heating areas 8 and 10 respectively in the direction of flow of the flow medium W in order to set a flow rate adapted to the respective heating. This helps to adapt the flow rate through the steam-generator tubes 13, 14 of the once-through heating areas 8, 10 to their different heating.

In the exemplary embodiment according to FIG. 3, a plurality of entry collectors 26 and 28 respectively and a plurality of discharge collectors 30 and 32 respectively are in each case allocated to each of the once-through heating areas 8, 10, as a result of which a group formation is possible in an especially simple manner. In this case, each of the entry collectors 26, 28 is commonly connected upstream of a number of the steam-generator tubes 13 and 14 of the respective once-through heating area 8, 10 in the direction of flow of the flow medium W. Each of the discharge collectors 30, 32, on the other hand, is commonly connected downstream of a number of the steam-generator tubes 13 and 14 of the respective once-through heating area 8 or 10 in the direction of flow of the flow medium W. In the exemplary embodiment according to FIG. 3, the steam-generator tubes 13, 14 of the once-through heating areas 8 and 10 respectively are again configured in such a way that, during operation of the steam generator the ratio of the friction pressure loss to the geodetic pressure drop in the respective steam-generator tube 13, 14 is on average less than 0.2 or 0.4 respectively. A choke device 34 is in each case connected upstream of the tube groups thus formed.

With regard to the construction of the once-through heating areas 8, 10, the once-through steam generator 1 is adapted to the spatially inhomogeneous heating of the steam-generator tubes 13, 14 as a result of the horizontal type of construction. The steam generator 1 is therefore also suitable for a horizontal type of construction in an especially simple manner.

We claim:

1. A steam generator, comprising:

an entry collector;

a discharge collector;

a heating-gas duct; and at least one once-through heating area disposed in said heating-gas duct through which a flow is conducted in an approximately horizontal heating-gas direction, said at least one once-through heating area formed from a number of approximately vertically disposed steam-generator tubes connected in parallel for a through flow of a flow medium, said steam-generator tubes configured such that a steam-generator tube of said steam-generator tubes heated to a greater extent compared with a further steam-generator tube of said steam-generator tubes has a higher flow rate of the flow medium compared with said further steam-generator tube, said steam-generator tube and said further steam-generator tube commonly connected to form a first end and a second end, said entry collector connected to said steam-generator tube and said further steam-generator tube at said first end and said discharge collector connected to said steam-generator tube and said further steam-generator tube collector at said second end.

2. The steam generator according to claim 1, wherein each of said steam-generator tubes of said at least one once-through heating area has a higher flow rate of the flow medium than each steam-generator tube of said steam-generator tubes disposed downstream of it in a heating-gas direction and belonging to the same said at least one once-through heating area.

3. The steam generator according to claim 1, wherein said steam-generator tubes of said at least one once-through heating area have a larger inside diameter than a steam-generator tube of said steam-generator tubes disposed downstream of it in a heating-gas direction and belonging to the same said at least one once-through heating area.

4. The steam generator according to claim 1, including a choke device being in each case connected upstream of a number of said steam-generator tubes of said at least one once-through heating area in a direction of flow of the flow medium.

5. The steam generator according to claim 1, including at least one of a plurality of entry collectors and discharge collectors connected to said at least one once-through heating area, each of said plurality of entry collectors commonly connected upstream of a number of said steam-generator tubes of said at least one respective once-through heating area in a direction of flow of the flow medium.

6. The steam generator according to claim 5, including a choke device connected upstream of at least one of said plurality of entry collectors.

7. The steam generator according claim 1, including a gas turbine disposed upstream of said heating-gas duct on a heating-gas side.

8. A steam generator, comprising:

a heating-gas duct; and at least one once-through heating area disposed in said heating-gas duct through which a flow is conducted in an approximately horizontal heating-gas direction, said at least one once-through heating area formed from a number of approximately vertically disposed steam-generator tubes connected in parallel for a through flow of a flow medium, said steam-generator tubes configured such that a steam-generator tube of said steam-generator tubes heated to a greater extent compared with a further steam-generator tube of said steam-generator tubes has a higher flow rate of the flow medium compared with said further steam-generator tube, said steam-generator tubes of said at least one once-through heating area having on average in each case a ratio of friction pressure loss to geodetic pressure drop at full load of less than 0.4.

9. The steam generator according to claim 8, wherein each of said steam-generator tubes of said at least one once-through heating area has a higher flow rate of the flow medium than each steam-generator tube of said steam-generator tubes disposed downstream of it in a heating-gas direction and belonging to the same said at least one once-through heating area.

10. The steam generator according to claim 8, wherein said steam-generator tubes of said at least one once-through heating area have a larger inside diameter than a steam-generator tube of said steam-generator tubes disposed downstream of it in a heating-gas direction and belonging to the same said at least one once-through heating area.

11. The steam generator according to claim 8, including a choke device being in each case connected upstream of a number of said steam-generator tubes of said at least one once-through heating area in a direction of flow of the flow medium.

12. The steam generator according to claim 8, including at least one of a plurality of entry collectors and discharge collectors connected to said at least one once-through heating area, each of said plurality of entry collectors commonly connected upstream of a number of said steam-generator tubes of said at least one respective once-through heating area in a direction of flow of the flow medium.

13. The steam generator according to claim 12, including a choke device connected upstream of at least one of said plurality of entry collectors.

14. The steam generator according claim 8, including a gas turbine disposed upstream of said heating-gas duct on a heating-gas side.

15. A steam generator, comprising:

a heating-gas duct; and at least one once-through heating area disposed in said heating-gas duct through which a flow is conducted in an approximately horizontal heating-gas direction, said at least one once-through heating area formed from a number of approximately vertically disposed steam-generator tubes connected in parallel for a through flow of a flow medium, said steam-generator tubes configured such that a steam-generator tube of said steam-generator tubes heated to a greater extent compared with a further steam-generator tube of said steam-generator tubes has a higher flow rate of the flow medium compared with said further steam-generator tube, said steam-generator tubes of said at least one once-through heating area having on average in each case a ratio of friction pressure loss to geodetic pressure drop at full load of less than 0.2.

16. The steam generator according to claim 15, wherein each of said steam-generator tubes of said at least one once-through heating area has a higher flow rate of the flow medium than each steam-generator tube of said steam-generator tubes disposed downstream of it in a heating-gas direction and belonging to the same said at least one once-through heating area.

17. The steam generator according to claim 15, wherein said steam-generator tubes of said at least one once-through heating area have a larger inside diameter than a steam-generator tube of said steam-generator tubes disposed downstream of it in a heating-gas direction and belonging to the same said at least one once-through heating area.

18. The steam generator according to claim 15, including a choke device being in each case connected upstream of a number of said steam-generator tubes of said at least one once-through heating area in a direction of flow of the flow medium.

19. The steam generator according to claim 15, including at least one of a plurality of entry collectors and discharge collectors connected to said at least one once-through heating area, each of said plurality of entry collectors commonly connected upstream of a number of said steam-generator tubes of said at least one respective once-through heating area in a direction of flow of the flow medium.

20. The steam generator according to claim 19, including a choke device connected upstream of at least one of said plurality of entry collectors.

21. The steam generator according claim 15, including a gas turbine disposed upstream of said heating-gas duct on a heating-gas side.

22. A steam generator, comprising:

a heating-gas duct; and at least one once-through heating area disposed in said heating-gas duct through which a flow is conducted in an approximately horizontal heating-gas direction, said at least one once-through heating area formed from a number of substantially linear and vertically disposed steam-generator tubes connected in parallel for a through flow of a flow medium, said tubes configured such that, in a first and a second steam-generator tube of said tubes of a same once-through heating area, during an increasing heating of said first steam-generator tube, a flow rate of the flow medium increases in said first tube at the cost of a flow rate of the flow medium in said second tube if said second tube is not heated to a greater extent.

* * * * *